US007114194B2

(12) United States Patent
English

(10) Patent No.: US 7,114,194 B2
(45) Date of Patent: Oct. 3, 2006

(54) SAFETY HELMET HAVING A VENTILATION ASSEMBLY

(75) Inventor: Thomas A. English, 6900 N. Libby, Oklahoma City, OK (US) 73132

(73) Assignee: Thomas A. English, Oklahoma City, OK (US)

( * ) Notice: Subject to any disclaimer, the term of this patent is extended or adjusted under 35 U.S.C. 154(b) by 84 days.

(21) Appl. No.: 10/940,399

(22) Filed: Sep. 14, 2004

(65) Prior Publication Data

US 2006/0053528 A1 Mar. 16, 2006

(51) Int. Cl.
*A42C 5/04* (2006.01)

(52) U.S. Cl. ..... 2/171.3

(58) Field of Classification Search ..... 2/171.3, 2/422, DIG. 1, 410, 424, 906, 206, 173, 7; 128/201.24, 201.25; D29/103; D2/866
See application file for complete search history.

(56) References Cited

U.S. PATENT DOCUMENTS 3,168,748 A * 2/1965 Limberg ..... 2/171.3
3,223,086 A * 12/1965 Denton ..... 128/201.24
3,391,407 A 7/1968 Waters
3,413,972 A * 12/1968 Depping ..... 128/201.23
3,765,031 A * 10/1973 Beresic ..... 2/422
3,813,696 A * 6/1974 Yeager ..... 2/171.3
3,822,698 A * 7/1974 Guy ..... 128/201.25
3,881,198 A 5/1975 Waters
4,095,289 A 6/1978 Kissen et al.
4,227,520 A 10/1980 Lord
4,309,774 A 1/1982 Guzowski
4,462,399 A * 7/1984 Braun ..... 128/201.25
4,502,480 A 3/1985 Yamamoto
4,612,675 A 9/1986 Broersma
4,744,106 A 5/1988 Wang (Continued)

FOREIGN PATENT DOCUMENTS

GB 2063074 A * 6/1981

*Primary Examiner*—Rodney Lindsey
(74) *Attorney, Agent, or Firm*—Dunlap, Codding & Rogers, P.C.

(57) ABSTRACT

A safety helmet having a shell constructed of a rigid material, the shell having a body portion and a brim portion extending outwardly from the body portion, the body portion having an exterior surface, an interior surface, an interior cavity defined by the interior surface of the body portion, and a bottom opening in open communication with the interior cavity, the interior cavity of the body portion sized to receive a portion of a head of a person. An adjustable webbing assembly is connected to the interior surface of the body portion for supporting the interior surface of the body portion of the shell a distance from the person's head. The safety helmet further includes a plenum extending along a portion of the exterior surface of the body portion of the shell, the plenum having an air inlet, at least one air outlet and an air flow passageway extending there between, the at least one air outlet of the plenum being in open communication with the interior cavity of the body portion of the shell. A fan is supported within the air flow passageway of the plenum such that the fan is disposed between the air inlet and the at least one air outlet of the plenum whereby upon activation of the fan, air is drawn into the air inlet of the plenum and discharged through the at least one air outlet of the plenum to cool the head of the person wearing the safety helmet.

13 Claims, 2 Drawing Sheets

U.S. PATENT DOCUMENTS

| | | | | | |
|---|---|---|---|---|---|
| 4,852,562 | A | | 8/1989 | Howie | |
| 5,054,480 | A | * | 10/1991 | Bare et al. | 128/201.25 |
| 5,283,914 | A | * | 2/1994 | James | 2/424 |
| 5,533,500 | A | * | 7/1996 | Her-Mou | 128/201.25 |
| 5,561,862 | A | | 10/1996 | Flores, Sr. | |
| 5,577,495 | A | * | 11/1996 | Murphy | 128/201.24 |
| 5,810,467 | A | * | 9/1998 | Hurwitz | 362/106 |
| 5,839,121 | A | | 11/1998 | Morales | |
| 5,878,742 | A | | 3/1999 | Figueredo | |
| 6,061,834 | A | | 5/2000 | Liao | |
| 6,122,773 | A | | 9/2000 | Katz | |
| D468,062 | S | | 12/2002 | Santiago | |
| 6,516,624 | B1 | | 2/2003 | Ichigaya | |
| 6,598,236 | B1 | | 7/2003 | Gantt | |
| 6,622,311 | B1 | * | 9/2003 | Diaz et al. | 2/171.3 |

* cited by examiner

SAFETY HELMET HAVING A VENTILATION ASSEMBLY

CROSS-REFERENCE TO RELATED APPLICATIONS

Not applicable.

BACKGROUND

The present invention relates to safety helmets, and more particularly but not by way of limitation, to safety helmets having a ventilation assembly for directing a supply of air over the head of a person wearing the safety helmet.

People who wear safety helmets often work under conditions which cause heat to build up beneath the safety helmet thereby at best causing discomfort and unsafe or unhealthy conditions. Although prior art safety helmets have been ventilated in various ways, such prior art safety helmets have not been well received or accepted. Further, many of the safety helmets of the prior art which contain a ventilating assembly have external openings or components extending therefrom which do not meet standards set by the U.S. Occupational Safety and Health Administration (OSHA).

In addition, even safety helmets worn in non-industrial or non-commercial venues have failed to solve the problem of how to efficiently and effectively cool down the head of a person wearing a safety helmet. Therefore, a need has long existed where an improved safety helmet having a ventilation assembly which is capable of effectively and efficiently cooling the head of a person wearing the safety helmet, and which complies with standards set by the U.S. Occupational Safety and Health Administration (OSHA). It is to such a safety helmet that the present invention is directed.

SUMMARY

The present invention relates to a safety helmet which conforms generally to the head of a person and which is capable of supplying a flow of air about the head of the person wearing the safety helmet in order to ventilate and/or cool the person's head. Broadly, the present invention relates to an article of headwear, such as a safety helmet, having a shell constructed of a rigid, impact resistant material, and an adjustable webbing assembly connected to an interior surface of the shell for active support of the shell a distance from the wearer's head. A plenum extends along a portion of an exterior surface of a body portion of the shell, the plenum having an air inlet, one or more air outlets, and an air flow passageway extending there between. The air outlet of the plenum is in open communication with an interior cavity of the body portion of the shell. A fan is supported within the air flow passageway of the plenum, the fan being disposed between the air inlet and the air outlet of the plenum whereby, upon activation of the fan, air is drawn into the air inlet of the plenum and discharged through the at least one air outlet of the plenum to cool the head of the wearer of the article of headwear. The article of headwear further includes an assembly for selectively activating and deactivating the fan.

DETAILED DESCRIPTION OF THE INVENTION

Figure 1:
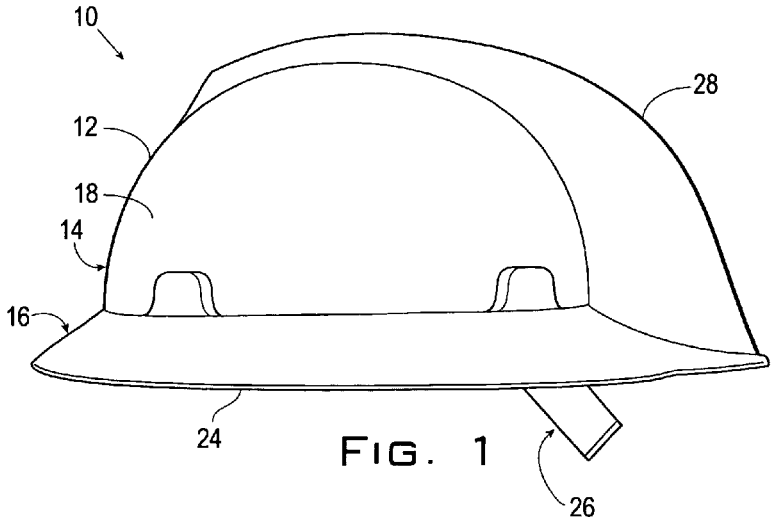
FIG. 1 is a side elevational view of a safety helmet constructed in accordance with the present invention.
Figure 2:
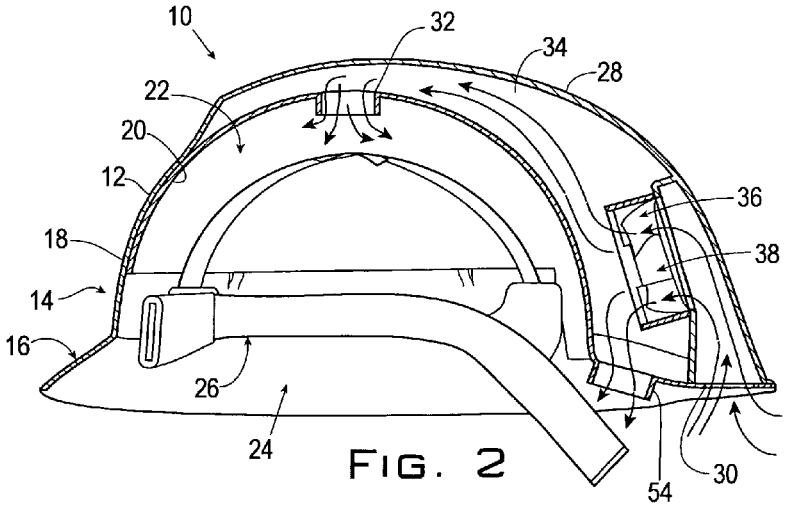
FIG. 2 is a diagrammatic, cross-sectional view of the safety helmet of FIG. 1 illustrating air flow through the safety helmet.
Figure 3:
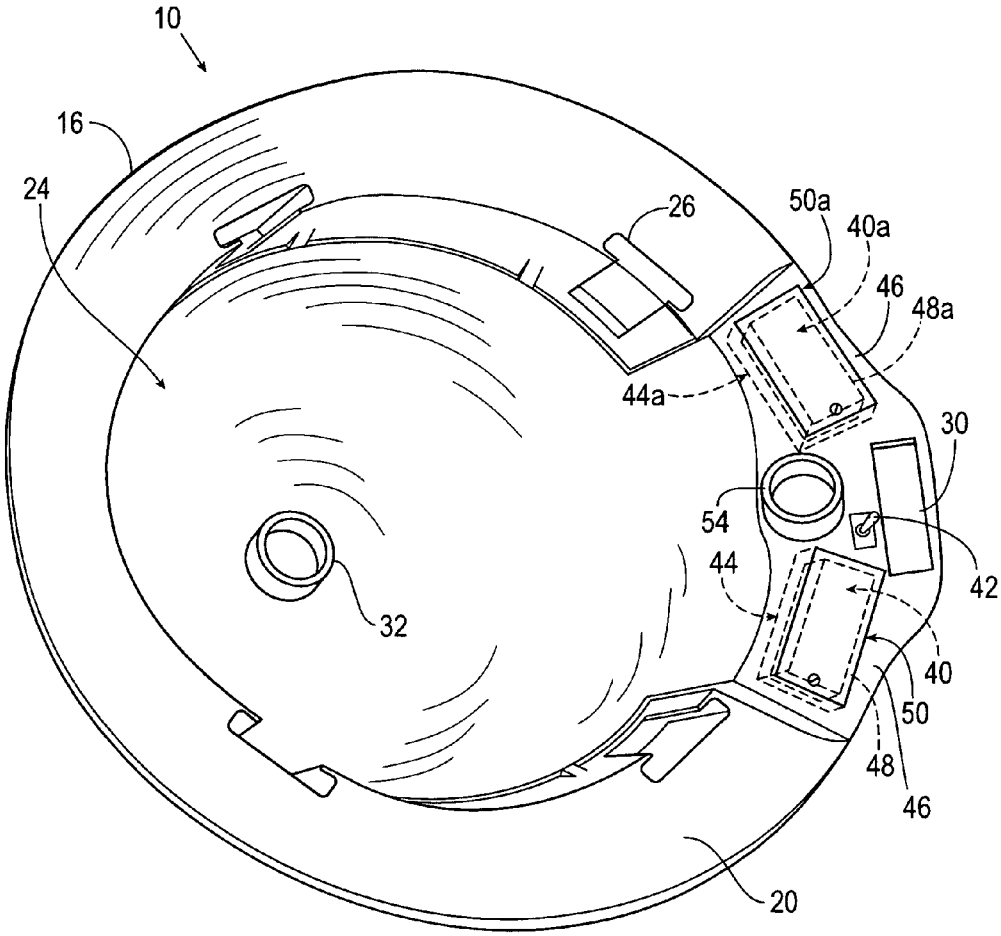
FIG. 3 is a perspective view of a bottom side of the safety helmet of FIG. 1.

Referring now to the drawings, and more particularly to FIGS. 1–3, shown therein and designated by the general reference numeral 10 is a safety helmet constructed in accordance with the present invention. The term "safety helmet" as used herein should be understood to include other additional terms such as hard hat, and the like. The safety helmet 10 of the present invention is capable of providing a flow of air to the head of a person wearing the safety helmet 10. The safety helmet 10 is constructed of a durable, impact resistant polymeric material capable of preventing damage to the wearer's head should an object fall and strike the safety helmet 10.

The safety helmet 10 includes a shell 12 having a body portion 14 and a brim portion 16 which extends outwardly from the body portion 14. The body portion 14 is provided with an exterior surface 18, an interior surface 20, an inner cavity 22 defined by the interior surface 20 of the body portion 14, and a bottom opening 24 in open communication with the inner cavity 22 of the body portion 14. The inner cavity 22 of the body portion 14 is sized and configured to receive a portion of a head of a person wearing the safety helmet 10. The safety helmet 10 is also provided with an adjustable webbing assembly 26 which includes straps, webbing, and attaching devices connected to the interior surface 20 of the body portion 14 of the shell 12 in a conventional manner such that the adjustable webbing assembly 26 maintains the interior surface 20 on the body portion 14 of the shell 12 a distance above the head of the person wearing the safety helmet 10.

The adjustable webbing assembly 26 is any one of numerous types of webbing assemblies made for safety helmets, hard hats, and the like such as the safety helmet 10, known to persons of ordinary skill in the art. The adjustable webbing assembly 26 is connected to the body portion 14 of the shell 12 in a conventional manner, such as detachable tabs. The adjustable webbing assembly 26 typically includes a plurality of nylon straps which substantially conform to the head of the person wearing the safety helmet 10 and which function to stabilize the safety helmet 10 on the person's head. Further, the adjustable webbing assembly 26 is desirably adjustable to accommodate various sizes of heads. Since the construction and attachment of the adjustable webbing assembly 26 to the body portion 14 of the shell 12 of the safety helmet 10 are well known to persons of ordinary skill in the art, no further comments concerning such adjustable webbing assembly 26, its connection to the body portion 14 of the shell 12 of the safety helmet 10, or its use, is deemed necessary.

As previously stated, the safety helmet 10 is shown in the drawings as a full brim helmet, i.e., a hard hat having the brim portion 16 that wraps completely around the body portion 14 of the shell 12 of the safety helmet 10. However, it should be noted that the safety helmet 10 described herein may be made in a variety of styles of hard hats, such as a cap style hard hat, or any other style of hard hat provided that the resulting hard hat has a body portion 14 and a brim or bill portion 16 of unitary construction with a continuous exterior surface 18 which is capable of having a ventilation assembly as will hereinafter be described with reference to the safety helmet 10.

The body portion 14 and the brim portion 16 of the shell 12 of the safety helmet 10 are preferably constructed out of a rigid, impact resistant resistant material which conforms to the general safety requirements of OSHA, such as polycarbonate, polycarbonate-fiber glass, polyester, polyester-fiber glass, ABS, phenol textile, PVC, or polyethylene or other materials which are well known to persons of ordinary skill in the art.

The safety helmet 10 further includes a plenum 28 which extends along a portion of the exterior surface 18 of the body portion 14. The plenum 28, which is shown as extending from the brim portion 16 of the shell 12 of the safety helmet 10, is provided with an air inlet 30, an air outlet 32, and an air flow passageway 34 extending between the air inlet 30 and the air outlet 32. The air outlet 32 of the plenum 28 is in open communication with the interior cavity 22 defined by the interior surface 20 of the body portion 14 of the shell 12. A ventilation assembly 36 is supported by the shell 12 of the safety helmet 10 for directing a flow of air through the air flow passageway 34 of the plenum 28 for discharge through the air outlet 32 of the plenum 28 to cool the head of the wearer of the safety helmet 10. The ventilation assembly 36 includes a fan 38 supported within the air flow passageway 34 of the plenum 28 such that the fan 38 is disposed between the air inlet 30 and the air outlet 32 of the plenum 28. Thus, upon activation of the fan 38, air is blown into the air inlet 30 of the plenum 28 and discharged through the at least one air outlet 32 of the plenum 28 to cool the head of the wearer of the safety helmet 10.

The ventilation assembly 36 further includes at least one battery, two batteries being shown and indicated by the numbers 40 and 40*a*, which are supported on the brim portion 16 of the shell 12 so as to be disposed near the air inlet 30 of the plenum 28 and a switch 42 which is operably connected to the batteries 40 and 40*a* and the fan 38 such that, upon movement of the switch 42 between an on and off position, the fan 38 is selectively activated and deactivated. As is clearly shown in FIG. 3, the shell 12 of the safety helmet 10 is further provided with a pair of housings 44 and 44*a* supported on a lower side 46 of the brim portion 16 so as to be disposed near the air inlet 30 of the plenum 28. Each of the housings 44 and 44*a* defines a chamber 48 and 48*a*, respectively, adapted to receive batteries 40 and 40*a*, substantially as shown. Closure members 50 and 50*a* are connectable to the housings 44 and 44*a* for closing off the chambers 48 and 48*a* and thereby cooperating with the housings 44 and 44*a* to encapsulate and stabilize the batteries 40 and 40*a* within the housings 44 and 44*a* while at the same time permitting access to the chambers 48 and 48*a* for positioning the batteries 40 and 40*a* in the chambers 48 and 48*a* and for removing the batteries 40 and 40*a* therefrom. Desirably, the housings 44 and 44*a* of the shell 12 are of the same unitary construction as the body portion 14 and the brim portion 16 of the shell 12.

As previously stated, the brim portion 16 of the shell 12 of the safety helmet 10 surrounding the air inlet 30 of the plenum 28, the housings 44 and 44*a* for the batteries 40 and 40*a* and the switch 42 are provided with a hollow configuration or at least passageways there between so as to provide interconnection of the batteries 40 and 40*a* and the switch 42 to the fan 38 of the ventilation assembly 36.

As shown in FIG. 3, the plenum 28 is provided with the air outlet 32, which constitutes a first air outlet and is employed to direct air moving through the air flow passageway 34 of the plenum 28 about the head of the person wearing the safety helmet 10. The plenum 28 can be further provided with a second air outlet 54 for directing air moving through the air flow passageway 34 of the plenum 28 to the back of the neck of the person wearing the safety helmet 10. Thus, the air outlet 32 of the plenum 28 is in open communication with the inner cavity 22 of the body portion 14 of the shell 12; whereas the second air outlet 54 extends through the lower surface of the brim portion 16 of the shell 12 substantially as shown.

As shown in the drawings, the plenum 28 and the shell 12, including the body portion 14 and the brim portion 16 thereof, do not contain any openings, holes or external components which would compromise the strength of the safety helmet 10. Further, it should be noted that the fan 38 does not blow directly onto the head of the person wearing the safety helmet 10, but directs air flow through the air flow passageway 34 of the plenum 28 for selective discharge through either the first air outlet 32 or second air outlet 54. It should further be noted that the plenum 28 may be provided with two or more air flow passageways that are disposed substantially parallel to one another along the shell 12 of the safety helmet 10 provided that each of the air flow passageways is in open communication with the fan 38 so that the fan 38 can direct air flow there through when the fan 38 is activated. Lastly, it should be understood that while the ventilation assembly 36 has been shown as containing batteries 40 and 40*a*, one or more than two batteries may be provided depending upon the power requirements of the fan 38.

While the preferred embodiment of the invention has been illustrated and described, it will be appreciated that various changes can be made therein without departing from the spirit and scope of the invention.

What is claimed is:

1. A safety helmet, comprising:

a shell constructed of a rigid material, the shell having a body portion and a brim portion extending outwardly from the body portion, the body portion having an exterior surface, an interior surface, an interior cavity defined by the interior surface of the body portion, and a bottom opening in open communication with the interior cavity, the interior cavity of the body portion sized to receive a portion of a head of a person;

an adjustable webbing assembly connected to the interior surface of the body portion for supporting the interior surface of the body portion of the shell a distance from the person's head;

a plenum extending along a portion of the exterior surface of the body portion of the shell, the plenum having an air inlet located on an underside of the brim portion of the shell so as to allow air to flow upwardly into the air inlet, at least one air outlet and an air flow passageway extending between the air inlet and the at least one air outlet whereby the plenum terminates at a position between the at least one air outlet and a brim portion of the shell oppositely disposed to the air inlet, the at least one air outlet of the plenum in open communication with the interior cavity of the body portion of the shell wherein the at least one air outlet is disposed in an area where the air flows through the at least one air outlet and over a top portion of the head of the person wearing the safety helmet; and a fan supported within the air flow passageway of the plenum such that the fan is disposed between the air inlet and the at least one air outlet of the plenum whereby upon activation of the fan, air is drawn into the air inlet of the plenum and discharged through the at least one air outlet of the plenum to cool the head of the person wearing the safety helmet.

2. The safety helmet of claim 1 further comprising: means for selectively activating and deactivating the fan.

3. The safety helmet of claim 2 wherein the shell further comprises:

at least one housing supported on a lower side of the brim portion, the at least one housing defining a chamber adapted to receive at least one battery; and a closure member connected to the at least one housing for selectively closing off the chamber and thereby cooperating with the at least one housing to encapsulate the at least one battery and for permitting access to the chamber for positioning the at least one battery therein.

4. The safety helmet of claim 3 wherein means for selectively activating and deactivating the fan comprises:

at least one battery supported within the chamber of the at least one housing; and a switch operably connected to the at least one battery and the fan such that, upon movement of the switch between an on and off position, the fan is selectively activated and deactivated.

5. The safety helmet of claim 2 wherein the shell further comprises:

a pair of housings supported on a lower side of the brim portion so that each of the housings is disposed near the air inlet of the plenum, each of the housings defining a chamber adapted to receive at least one battery; and a closure member connectable to each of the housings for selectively closing off the chamber and thereby cooperating with the housings to encapsulate the batteries and for permitting access to the chamber for positioning of the batteries therein.

6. The safety helmet of claim 2 wherein the means for selectively activating and deactivating the fan comprises:

two batteries supported on a lower side of the brim portion of the shell so that each battery is disposed near the air inlet of the plenum; and a switch operably connected to the batteries and the fan such that, upon movement of the switch between an on and off position, the fan is selectively activated and deactivated.

7. The safety helmet of claim 1 wherein the shell further comprises:

a pair of housings supported on a lower side of the brim portion so that each of the housings is disposed near the air inlet of the plenum, each of the housings defining a chamber adapted to receive at least one battery; and a closure member connectable to each of the housings for selectively closing off the chamber and thereby cooperating with the housings to encapsulate the batteries and for permitting access to the chamber for positioning of the batteries therein.

8. The safety helmet of claim 7 wherein the body portion, the brim portion and each of the housings of the shell defining the chamber adapted to receive the batteries are of unitary construction.

9. A safety helmet, comprising:

a shell constructed of a rigid, impact resistant material, the shell having a body portion and a brim portion extending outwardly from the body portion, the body portion having a exterior surface, an interior surface, an interior cavity defined by the interior surface of the body portion, and a bottom opening in open communication with the interior cavity, the interior cavity of the body portion sized to receive a portion of a head of a person;

means connected to the shell for supporting the interior surface of the body portion of the shell a distance from the person's head;

a plenum extending from the brim portion of the shell and along a rearward portion of the exterior surface of the body portion of the shell, the plenum having an air inlet, a first air outlet, a second air outlet and an air flow passageway extending between the air inlet and the first and second air outlets, the air inlet of the plenum disposed on an underside of the brim portion of the shell and the first air outlet of the plenum being disposed in an area where the air flows downwardly through the first air outlet over a top portion of the head of the person wearing the safety helmet, the plenum terminating at a position between the first air outlet and a brim portion of the shell oppositely disposed to the air inlet;

a fan supported within the air flow passageway of the plenum such that the fan is disposed between the air inlet and the first and second air outlets of the plenum so that upon activation of the fan air is drawn into the air inlet of the plenum and discharged through the first and second air outlets of the plenum to cool the head and neck of the person wearing the safety helmet; and means for selectively activating and deactivating the fan.

10. The safety helmet of claim 9 wherein the shell further comprises:

a pair of housings supported on a lower side of the brim portion so that each of the housings is disposed near the air inlet of the plenum, each of the housings defining a chamber adapted to receive at least one battery; and a closure member connectable to each of the housings for selectively closing off the chamber and thereby cooperating with the housings to encapsulate the batteries and for permitting access to the chamber for positioning of the batteries therein.

11. The safety helmet of claim 10 wherein the exterior surface of the body of the shell, the brim portion of the shell and the plenum are of unitary construction and provide the safety helmet with a continuous exterior surface.

12. The safety helmet of claim 11 wherein the means for selectively activating and deactivating the fan comprises:

two batteries supported on a lower side of the brim portion of the shell so that each battery is disposed near the air inlet of the plenum;

a switch operably connected to the batteries and the fan such that, upon movement of the switch between an on and off position, the fan is selectively activated and deactivated.

13. The safety helmet of claim 12 wherein the second air outlet of the plenum is positioned so as to direct air moving through the air passageway of the plenum onto the back of the neck of the person wearing the safety helmet.

* * * * *